United States Patent [19]

Tocchio

[11] Patent Number: 4,543,895

[45] Date of Patent: Oct. 1, 1985

[54] MACHINE FOR MAKING A FLY STRUCTURE

[75] Inventor: Louis A. Tocchio, Abington, Mass.

[73] Assignee: The Reece Corporation, Waltham, Mass.

[21] Appl. No.: 616,821

[22] Filed: Jun. 4, 1984

[51] Int. Cl.[4] ..... D05B 3/12

[52] U.S. Cl. ..... 112/104; 112/121.11; 112/121.27; 112/141; 112/147; 112/152; 112/113

[58] Field of Search ..... 112/121.12, 121.11, 112/121.15, 121.14, 121.27, 136, 141, 147, 152, 104, 113

[56] References Cited

U.S. PATENT DOCUMENTS

| | | | |
|---|---|---|---|
| 1,296,632 | 3/1919 | DeVoe | 112/147 |
| 2,236,218 | 3/1941 | Marks | 2/234 |
| 2,894,469 | 7/1959 | Van Amburg et al. | 112/136 |
| 3,263,238 | 8/1966 | Waldes | 2/265 |
| 3,277,851 | 10/1966 | Dobner et al. | 112/121.12 |
| 3,752,100 | 8/1973 | Sharp | 112/147 X |
| 3,765,348 | 10/1973 | Jabor et al. | 112/121 |
| 4,037,547 | 7/1977 | Marjorio | 112/121.27 |
| 4,362,116 | 12/1982 | Sen Gupta et al. | 112/265 |

*Primary Examiner*—H. Hampton Hunter

*Attorney, Agent, or Firm*—Garrett J. Cullen, Jr.

[57] ABSTRACT

This invention relates to a machine for forming a fly structure in a garment or the like and more particularly to a machine which folds a fly flap portion which is integral with the garment panel to form a double welt along the exposed edge of the finished fly structure and then places and secures one half of a slide fastener tape to the fly flap portion.

26 Claims, 22 Drawing Figures

MACHINE FOR MAKING A FLY STRUCTURE

BACKGROUND OF THE INVENTION

In the manufacture of garments and more particularly trousers or the like, the most common method used is to provide separate fly pieces for attachment to the main garment panel. When forming the exposed portion of the fly structure this results in a double welt along the edge which provides substantial rigidity and reinforcement to the completed structure.

The usual method of accomplishing this structure is to first cut fly pieces from the supply of material then feed the fly pieces in conjunction with continuous length of a slide fastener tape to a sewing machine, severing the slide fastener tape between the flypieces, and then attaching an edge of the fly piece to the edge of the main garment in a predetermined position by feeding these parts to a separate sewing machine. In view of the number of parts involved this construction has not lent itself to mechanization in one machine. Further since various operators are involved in performing the same function, the consistency of structure and appearance orginating from a single manufacturer will vary depending upon the dexterity of such operators.

Previous modifications in the assembly of the fly structure including the use of a fly flap portion integral with the main garment panel have been tried. However, the feeding of the main panel in conjunction with the continous slide fastener tape and the severing of the tape between panels have presented problems. Therefore it has been necessary to perform these operations individually which requires a great deal of manual handling which is time consuming and expensive. Also the inconsistencies due to the skill of the various operators performing like functions still presents a problem for the manufacturer.

In the U.S. patent application Ser. No. 491,872 filed May 5, 1983 in the name of Donald Richardson there is disclosed a structure of and method of forming a completed fly structure in a garment wherein the fly flap portions are cut integral with the main panel. Further U.S. patent application Ser. No. 535,714 filed Sept. 26, 1983 in the name of Doucette ET AL shows a machine for folding and attaching the zipper to the integral fly flap on the covered half of the fly structure. The machine of the present invention folds the integral fly flap and attaches the zipper to the exposed half of the fly structure.

SUMMARY OF THE INVENTION

The object of this invention is to provide a machine for forming the exposed portion of a fly structure in a garment, such as trousers or the like, in which the fly flap portion is cut integral with the main garment panel.

Another object of this invention is to provide a machine for forming the exposed portion of a fly structure in a garment and which machine reduces the skill required by the operator thereof.

A further object of this invention is to provide a machine for forming a double fold along the free edge of the exposed portion of a fly structure which is formed in a garment which has the fly flap portion cut integral with the main garment panel.

A still further object of this invention is to provide a machine for forming a double fold in and attaching a slide fastener stringer to the fly flap portion of a garment in which the fly flap portion has been cut integral with the garment panel.

Yet another object of this invention is to provide a machine for forming the exposed half of a fly structure in a garment having the fly flap portion integral with the garment panel and which requires minimum skill to operate and produce consistent quality garments.

A further object of this invention is to provide a machine for forming the exposed half of a fly structure in a garment having the fly flap portion integral with the garment panel in which the operator merely has to position the garment panel and start the machine.

These and other objects and advantages of the present invention will become more readily apparent from the following detailed description of the preferred embodiments and from the accompanying drawings.

DESCRIPTION OF THE DRAWINGS AND PREFERRED EMBODIMENT

Figure 1:
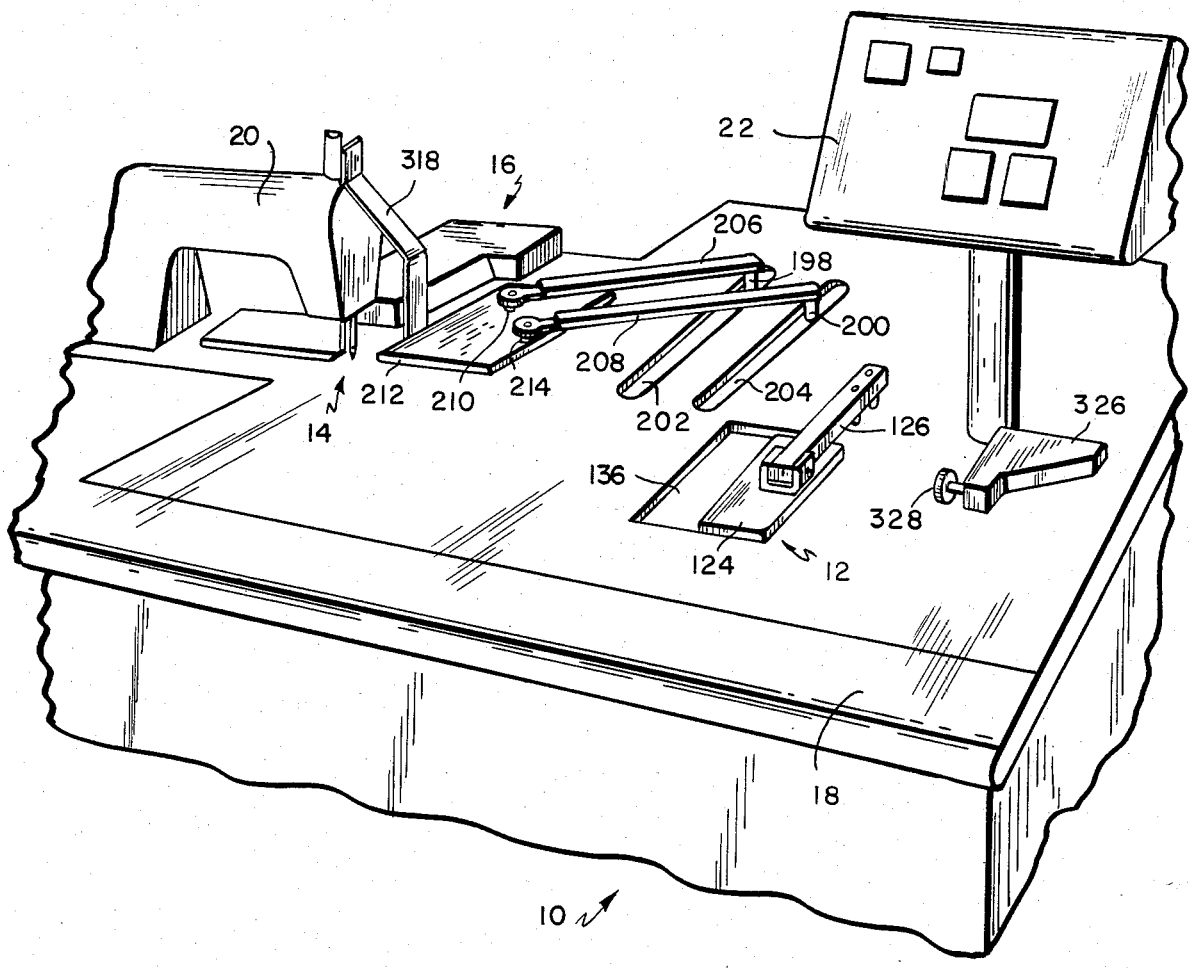
FIG. 1 is a perspective view of the machine forming the subject of this invention and showing the general location of the various stations.

Referring now to FIG. 1 there is shown the main body of the machine indicated generally at 10, having a folding station 12, a sewing station 14 and an unfolding zipper placing station 16. Mounted on the top surface 18 of the main body at the sewing station 14 is a sewing machine 20. Also mounted on the top surface 18 of the machine adjacent the folding station 12 is a control panel 22 which carries the necessary switches for operating the machine.

Figure 2:
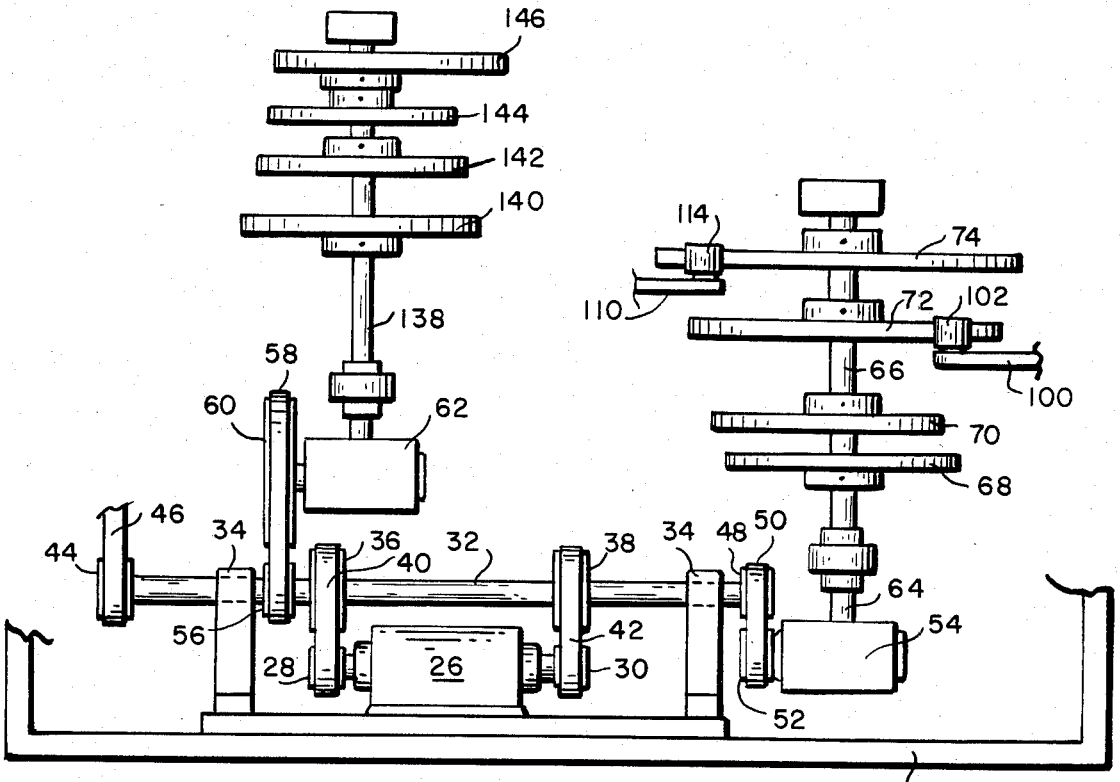
FIG. 2 is a plan view showing the drive motor and main shafts of the machine forming the subject of this invention.
Figure 3:
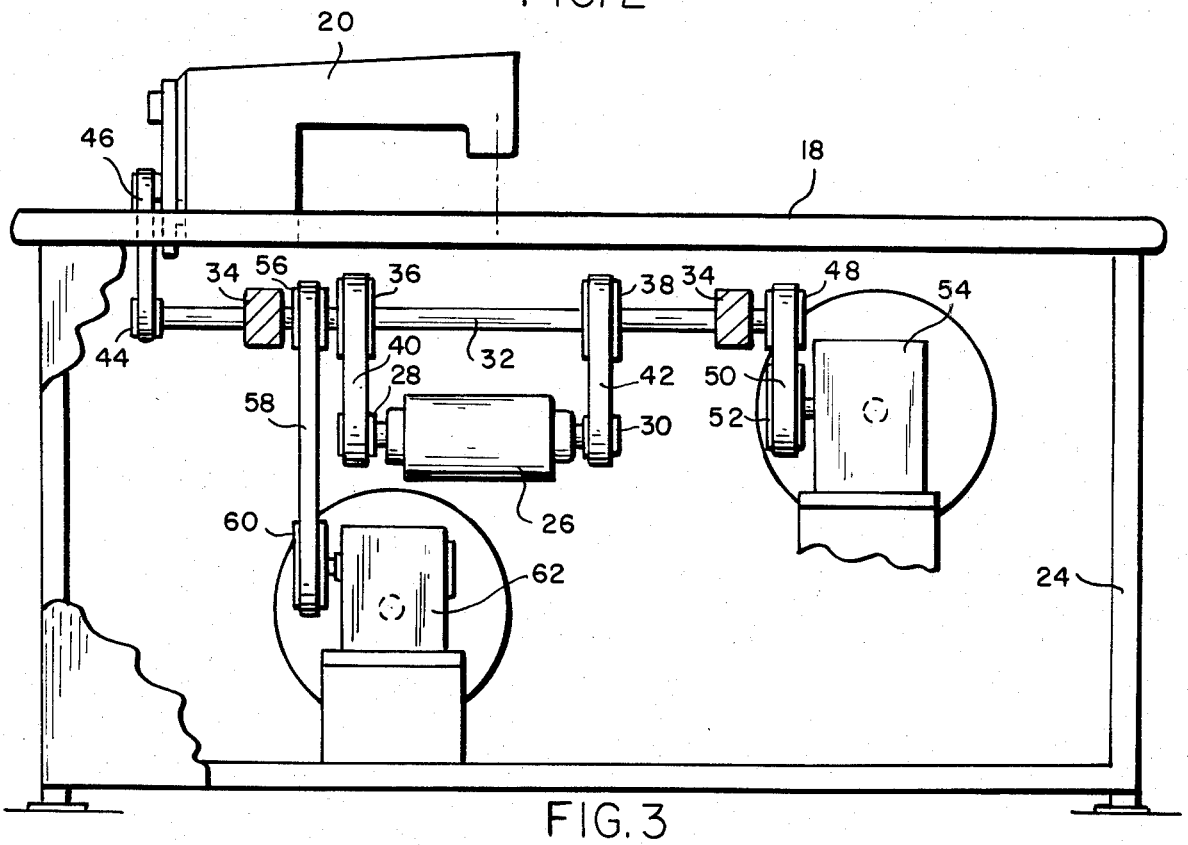
FIG. 3 is an elevational view showing the motor and drive shafts of FIG. 1.

As seen in FIGS. 2 and 3, the top surface 18 is supported on a frame generally indicated at 24. Secured on the frame 24 below the top surface 18 is a drive motor 26, having pulleys 28 and 30 mounted at opposite ends of the motor shaft. A drive shaft 32 is mounted in bearings 34 supported on the frame 24 and extends parallel to the motor shaft. Clutch mounted pulleys 36 and 38 are mounted on the drive shaft 32 in line with the pulleys 28 and 30 on the motor shaft. An endless belt 40 connects pulley 28 with clutch mounted pulley 36, and an endless belt 42 connects pulley 30 with clutch mounted pulley 38 to enable the motor to be selectively connected to pulleys 36 and 38.

A pulley 44 is secured to one end of the shaft 32 and is connected by an endless belt 46, which passes upwardly through the top surface 18, to the driving pulley of the sewing machine 20. The other end of the shaft 32 has a pulley 48 mounted thereon, which pulley 48 is connected by means of belt 50 to a pulley 52 on the input shaft of right angle gear box 54. A further pulley 56 is mounted on shaft 32 and is connected by belt 58 to pulley 60 on the input shaft of a second right angle gear box 62. Both gear boxes 54 and 62 are fixedly mounted on the frame 24 of the machine as seen in FIG. 3.

The output shaft 64 of gear box 54 is connected to a shaft 66 which extends below the folding station 12. Fixedly secured to the shaft 66 are a plurality of cams 68, 70, 72 and 74. The cams 68, 70, 72 and 74 operate the folding elements of the machine in a predetermined timed sequence.

Figure 4:
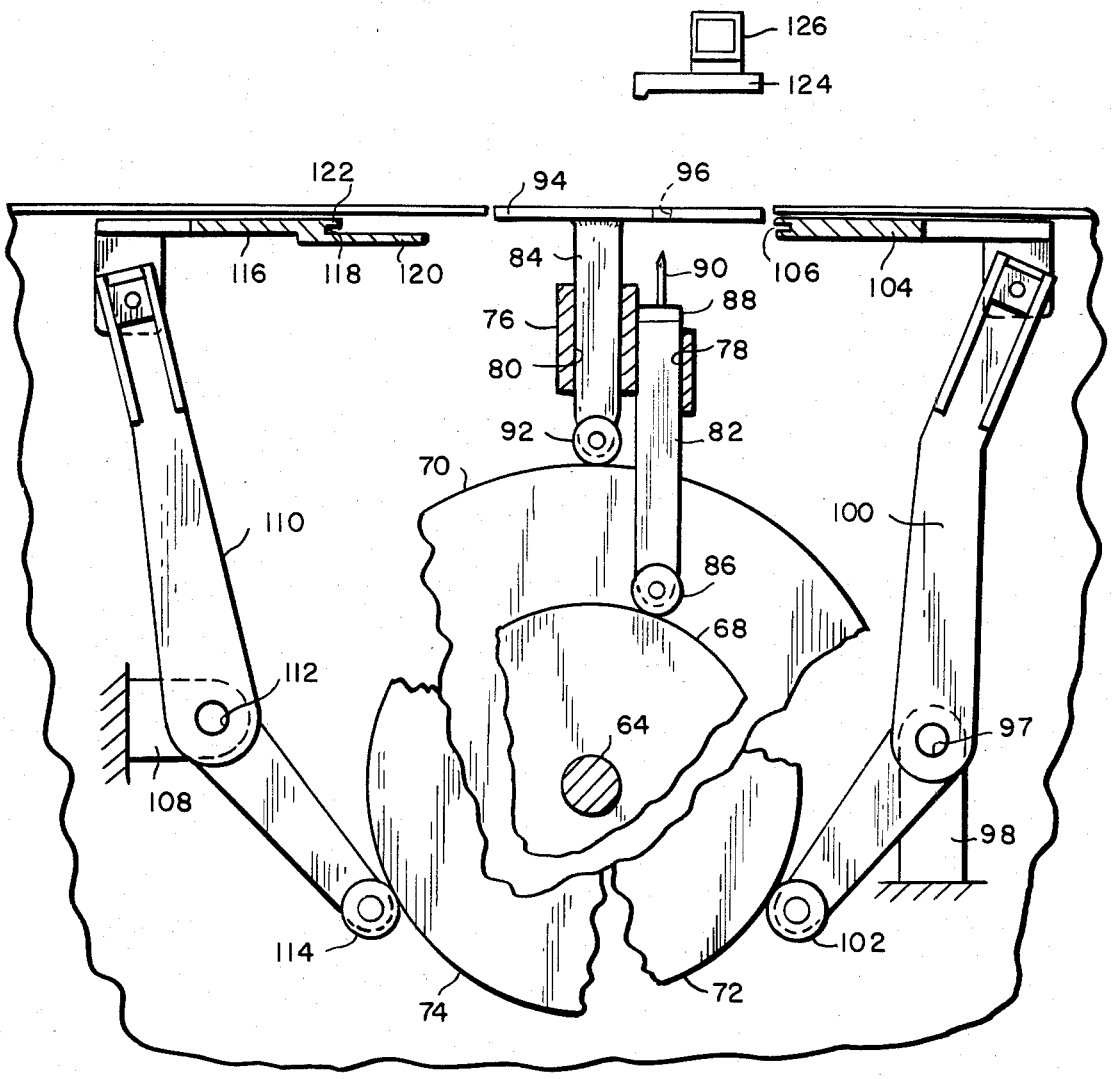
FIG. 4 is an elevational view showing the connections between the drive shaft and the various folding elements.
Figure 9:
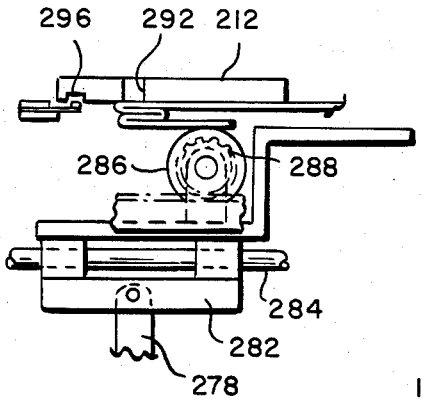
FIG. 9 is a sectional view taken along line 9—9 of FIG. 8.

As seen in FIG. 4 a bracket 76 is provided with vertical apertures 78 and 80 which receive vertically sliding rods 82 and 84. The bracket 76 is fixedly mounted in predetermined position on the frame of the machine. The lower end of the rod 82 is provided with a roller 86 which is urged into engagement with the edge of cam 68 by any suitable means such as a spring. The upper end of the rod 82 carries a bar 88 extending parallel to the shaft 64. The bar 88 is provided with a plurality of upwardly extending pins 90 for a purpose to be described later.

The rod 84 is also provided at its lower end with a roller 92 which is in engagement with the cam 70. The upper end of the rod 84 carries a support plate 94 which moves up and down with the rod 84 in response to the contour of cam 70. The support plate 94 is provided with a plurality of holes 96 in alignment with the pins 90, for a purpose to be described later. The roller 92 on the lower end of rod 84 is also urged into engagement with cam 70 by any suitable means.

Pivotally mounted intermediate its ends as at 97 on a bracket 98 is an arm 100. One end of the arm 100 is provided with a roller 102 which is urged by suitable means into engagement with the cam 72. The other end of the arm extends upwardly adjacent the top surface of the machine. The arm 100 is connected by a suitable connection to one end of a folding plate 104. The other end of the folding plate 104 extends toward the side of shaft 64 opposite pivot point 97. The free edge of folding plate 104 is provided with a groove 106 with its opening facing away from the arm 100 for a purpose to be described later.

On the side of shaft 64 opposite bracket 98, another bracket 108 is mounted in fixed position on the machine frame 24. This bracket 108 has pivotally mounted thereon an arm 110 whose pivot point 112 is intermediate its ends. The arm 110 carries a roller 114 at one end and which roller is urged by suitable means into engagement with the cam 74. The other end of the arm 110 extends upwardly and is connected by a suitable connection to folding plate 116. The plate 116 extends toward the plate 114 and is provided with a groove 118 having its opening facing the groove 106 in folding plate 104. The lips formed by the groove 118 are of unequal length with the lower lip 120 extending a much greater distance toward the plate 104 than upper lip 122. Further the grooves 118 and 106 are offset vertically from one another so that as the plates 104 and 116 move toward each other, the lip 120 will pass under plate 104 and lip 122 will enter groove 106 with the lower lip of groove 106 entering groove 118.

Figure 5:
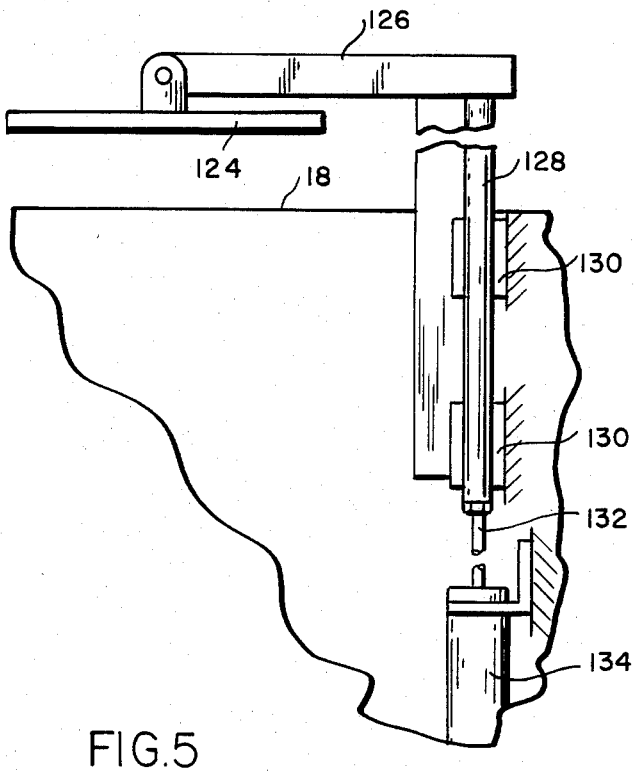
FIG. 5 is a view showing the mounting of the upper clamp plate.

Mounted above the upper surface 18 is an upper clamping member 124. As seen in FIG. 5, the clamping member 124 is supported on one end of an arm 126 having its other end connected to the upper end of a rod 128 mounted for vertical movement in bushings 130 which are fixedly mounted on the frame 24 of the machine. The lower end of rod 128 is connected to the piston rod 132 of cylinder 134 which moves the rod 128 vertically at predetermined times. The upper surface 18 is provided with an opening 136 through which the various elements can move.

Secured to the output shaft of gear box 62 is a shaft 138 which is mounted for rotation on the frame 24 of the machine in parallel relation to the shaft 66. The shaft 138 carries a plurality of cams 140, 142, 144 and 146 mounted in spaced apart relation thereon. The cams 140, 142, 144 and 146 control the movement of the work through the sewing station 14, and the unfolding zipper placing station 16 in a predetermined sequence.

Figure 6:
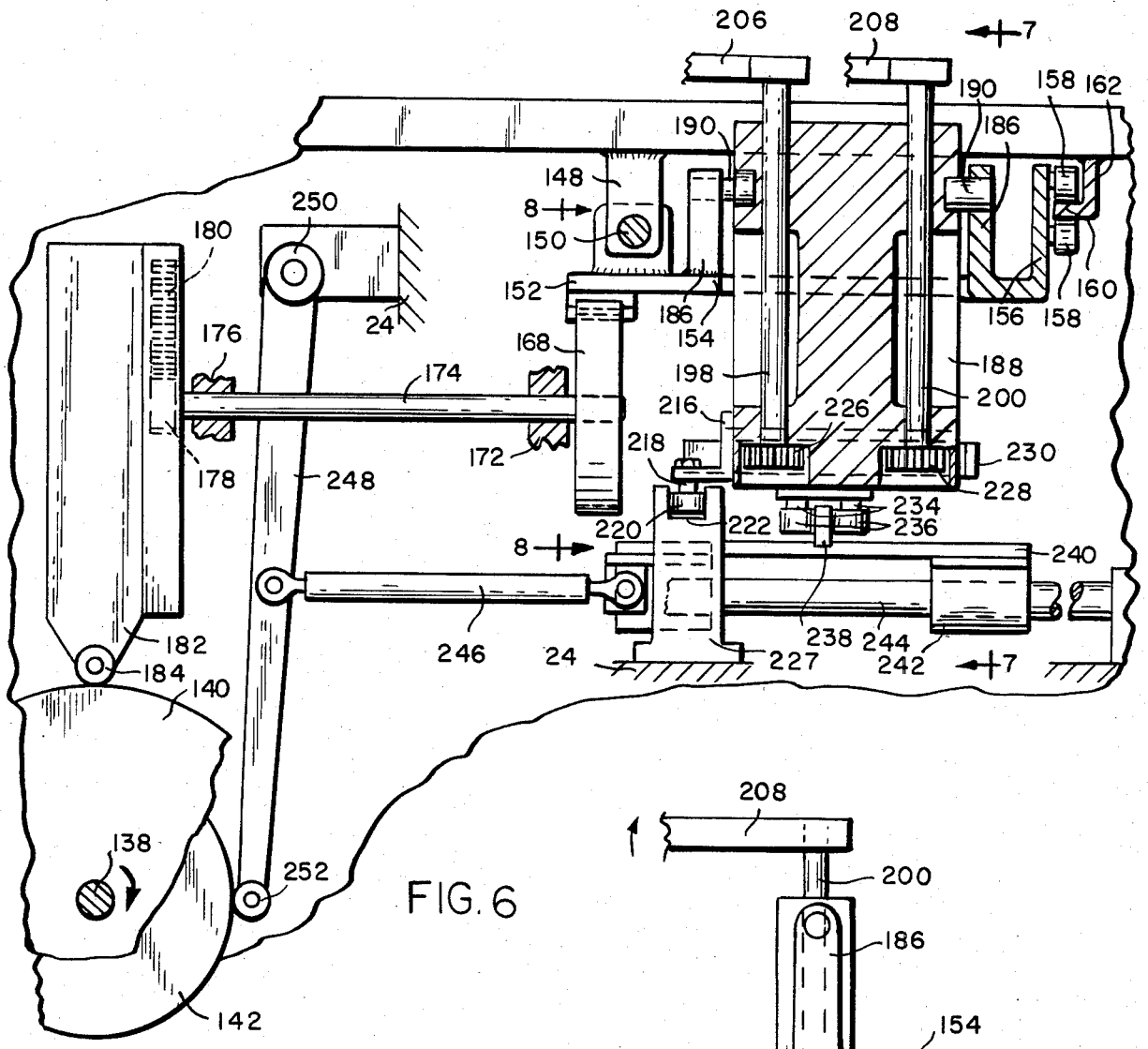
FIG. 6 is an elevational view showing the connections between the drive shaft and the transfer means.

Secured to the undersurface of the top 18 by brackets 148 is a shaft 150 which extends parallel to the shaft 138 (see FIG. 6). Mounted for sliding movement on the shaft 150 is one end 152 of a bracket 154. The other end 156 of bracket 154 is provided with a pair of rollers 158 which straddle a horizontal lip 160 of flange 162 mounted on the undersurface of the top 18. The lip 160 extends parallel to the shaft 138 and to shaft 150.

Figure 8:
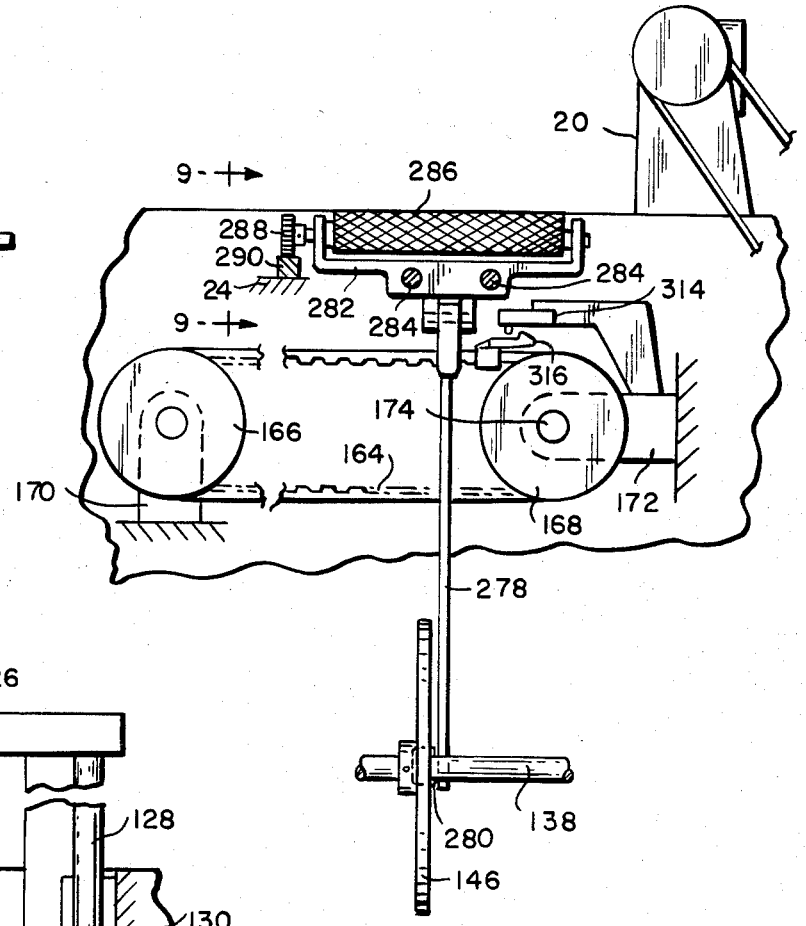
FIG. 8 is a sectional view taken along line 8—8 of FIG. 6.

The end 152 of the bracket 154 is clamped to an endless toothed belt 164 which is entrained around a pair of pulleys 166 and 168 mounted for rotation on brackets 170 and 172 secured to the frame 24 of the machine (see FIG. 8). The belt 164 moves in a direction parallel to shaft 150 so that as the pulleys rotate to drive the belt 164 the bracket 154 will move back and forth on the shaft 150. The pulley 168 is mounted on a shaft 174 which is supported on bracket 172 adjacent one end and a bracket 176 adjacent its other end. The other end of the shaft 174 has mounted thereon a gear 178.

The gear 178 is in mesh with a rack 180 secured to a plate 182 mounted for vertical sliding movement on the frame 24 of the machine. The lower end of plate 182 has a roller 184 mounted thereon, which roller 184 is in engagement with the cam 140 mounted on shaft 138. Thus as shaft 138 rotates the cam 140 will rotate and the plate 182 will rise and fall due to the contour of the cam 140. The vertical movement of the rack 180 attached to plate 182 will rotate shaft 174 thus rotating driving pulley 168 which drives the belt 164. The belt 164 thus moves the bracket 154 back and forth.

Figure 7:
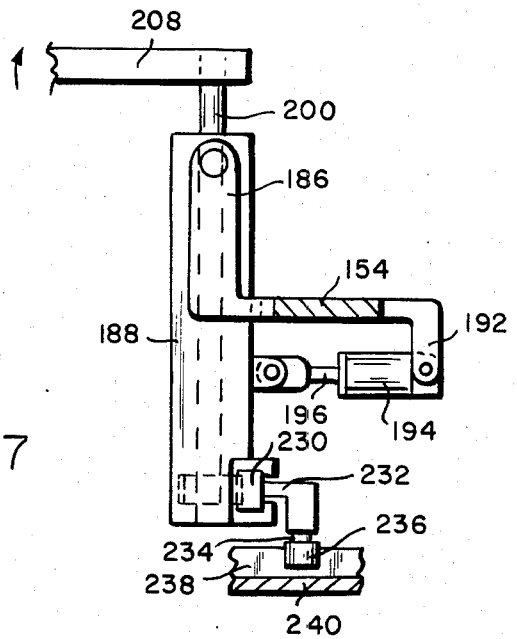
FIG. 7 is a view of the transfer means taken along line 7—7 of FIG. 6.

The bracket 154 is provided with a pair of spaced apart upstanding ears 186. The upper end of a housing 188 is supported between the ears 186 on pivot pins 190 for limited swinging movement. As seen in FIG. 7, the bracket 154 is provided with an extension 192 having one end of a cylinder 194 attached thereto. The piston rod 196 of the cylinder 194 has its free end connected to the housing 188. Thus movement of the piston rod 196 in and out of cylinder 194 will cause the hanger 188 to swing on the pivot pins 190.

Extending vertically in the housing 188 are a pair of shafts 198 and 200. These shafts pass upwardly from the housing 188 and through parallel slots 202 and 204 in the top 18 of the machine. Fixedly secured to shaft 198 is one end of an arm 206 and fixedly secured to shaft 200 is one end of an arm 208. The other end of arm 206 is pivotally connected to a pivot pin 210 on a transfer clamp 212. The other end of arm 208 is pivotally connected to a pivot pin 214 on the transfer clamp 212.

Secured to the hanger 188 at the bottom thereof is a bracket 216 having a horizontal lip on which is mounted a vertical pin 218. The pin 218 supports a roller 220 which rides in a groove 222 on a bracket 224 mounted on the frame 24. The groove 222 extends parallel to the shaft 150 and lip 160.

Secured to the lower end of shaft 198 is a gear 226 and to the lower end of shaft 200 is a similar gear 228. A rack 230 is slidably mounted on the hanger 188 in engagement with the gears 226 and 228. Therefore as the rack 230 moves back and forth it will rotate gears 226 and 228 thus turning the shafts and swinging the arms 206 and 208 which in turn will swing the transfer clamp 212 from the folding to the sewing station and vice versa.

In order to move the rack 230 and retain it in fixed position in the various positions of the hanger 188, the rack 230 has fixed thereon a L-shaped bracket 232 which supports a pair of downwardly extending pins 234 having rollers 236 at their lower end. The rollers 236 straddle an elongated rib 238 mounted on a plate 240. The rib 238 extends parallel to the shaft 150. The plate 240 is mounted by means of bushings 242 on parallel shafts 244 (one of which is shown in FIG. 6) secured to the frame 24. With this construction the hanger 188 can move to and fro with the arms 206 and 208 in fixed position and the rollers 236 will merely travel along the rib 238. If the plate 240 is shifted across the direction of travel of the hanger 188 the rack will move causing the swinging of transfer clamp 212.

The plate 240 is connected to one end of a rod 246. The other end of rod 246 is connected to a lever 248 adjacent its mid-point. One end of the lever 248 is pivotally connected as at 250 to the frame 24 of the machine. The other end of the lever 248 has a roller 252 mounted thereon which roller 252 is maintained in engagement with cam 142 by any suitable means. Thus cam 142 controls the swinging movement of the transfer clamp 212.

Figure 11:
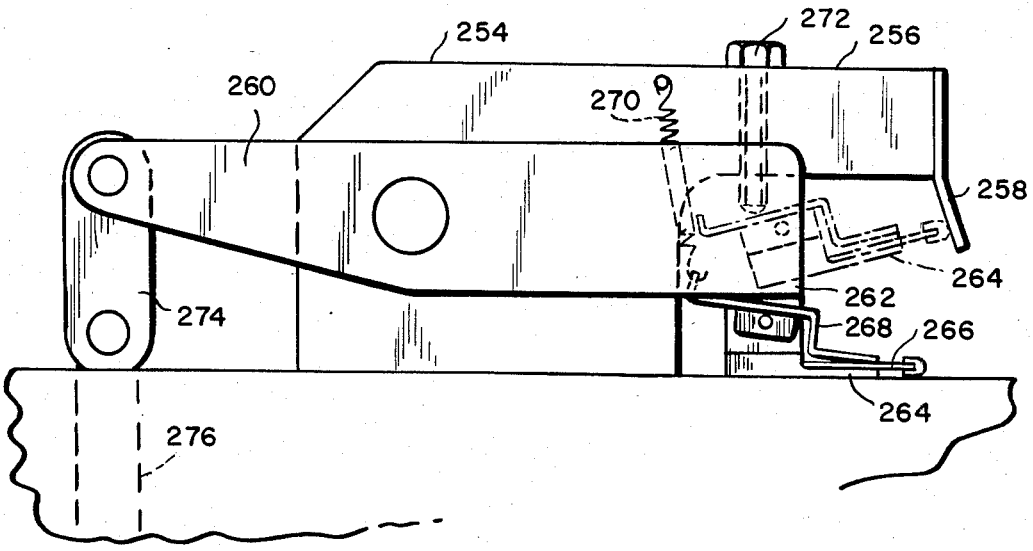
FIG. 11 is an elevational view of the zipper clamping means.

As seen in FIG. 11, a zipper clamp is provided on the machine adjacent the sewing machine. The clamp comprises a support 254 mounted on the top surface 18 and extending upwardly therefrom. The support is provided with an arm 256 overlying the top 18 and the free end of the arm 256 terminates in a downwardly extending guide 258 for a purpose to be described later. The vertical portion of support 254 has a lever 260 pivotally mounted thereon with one end 262 of the lever extending under the arm 256 and forming a lower lip 264 for supporting a zipper tape 266.

Pivotally mounted on the end 262 is an upper clamping member 268 which is urged by means of a spring 270 into contact with the lip 264 as seen in solid lines in FIG. 11. In order to load the tape 266 in the clamp, it is necessary to open the clamp. This is accomplished by rotating the lever 260 counter clockwise thus raising the clamp. An adjustable abutment 272 mounted on the arm 256 will engage the upper clamping member 268 causing it to pivot against the action of spring 270 thereby opening the clamp as the clamp continues to rise. With the clamp in the position shown in dotted lines in FIG. 11, the zipper 266 can be fed lengthwise into the clamp. One type of zipper feed for inserting the zipper tape in the clamp is shown in U.S. patent application Ser. No. 535,714 filed Sept. 26, 1983. The guide 258 engages the teeth of the zipper tape 266 and keeps it in line as it is fed into the clamp and maintains the tape in position during the clamping action.

The other end of lever 260 is pivotally connected through a link 274 to a rod 276 passing downwardly through the top 18 of the machine. The lower end of the rod 276 will be provided with a roller, not shown, in engagement with cam 144 on shaft 138. Thus as the rod 276 is moved up and down by cam 144 the clamp will move between the dotted and solid positions shown in FIG. 11.

The cam 146 on shaft 138 controls the unfolding operation at unfolding station 16. An arm 278 is pivotally mounted on the frame 24 and is provided at its lower end with a roller 280 in engagement with cam 146. The upper end of the arm 278 is pivotally connected to a frame 282 slidably mounted on a pair of parallel rods 284 secured to the undersurface of the top 18. A roller 286 is journalled in the frame 282 and extends upwardly through an opening in the top 18 with its top most point substantially flush with the upper surface of the top 18.

The roller 286 is provided at one end with a gear 288 fixedly mounted thereon and in engagement with a rack 290 mounted on the frame 24 of the machine. Thus as the arm 278 moves the frame 282 back and forth rotation will be imparted to the roller 286 through the gear 288 riding on the rack 290.

In order to maintain the various rollers in engagement with their respective cams known means such as springs or the like can be used without departing from the scope of this invention.

Figure 10:
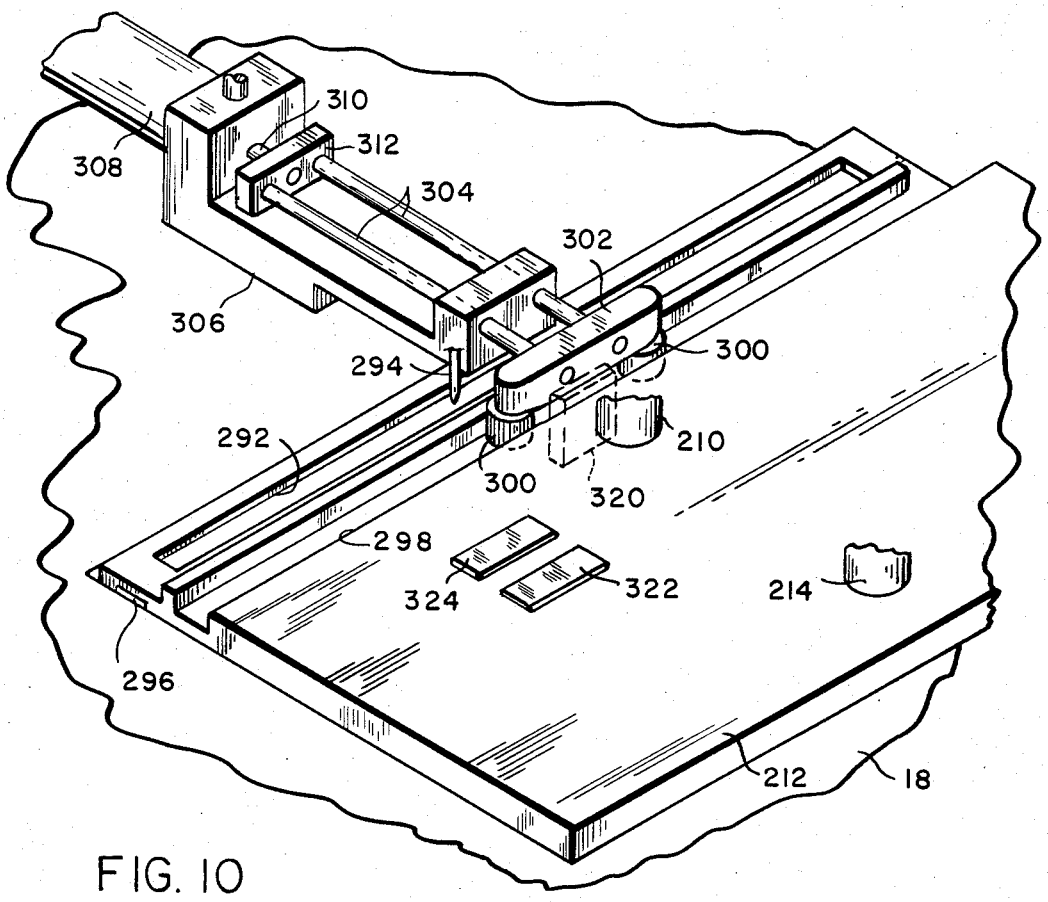
FIG. 10 is a perspective view of the transfer means showing it in engagement with the indexing means.

Referring to FIG. 10, the transfer clamp 212 is shown provided with a longitudinal sewing slot 292 extending therethrough adjacent one edge thereof. This slot 292 is of a width sufficient to permit the reception of a double fold of whatever type of material is to be provided with folds in accordance with this invention. The bottom surface of the transfer clamp 212 is provided with an upwardly extending groove 296 for receiving the fastener elements of the zipper tape 266. The upper surface of the transfer clamp is further provided with a longitudinal groove 298 for receiving control elements to guide the transfer clamp 212 through the sewing machine 20 in a straight line.

Disposed within the groove 298 are a pair of rollers 300 which are mounted on a bar 302 fixedly mounted on a pair of parallel rods 304. The rods 304 are mounted for sliding movement in a bracket 306 which is fixedly secured in position on the sewing machine 20. Also mounted on the bracket 306 is a cylinder 308 having its piston rod 310 connected to a bar 312 secured to the other ends of the rods 304. Thus displacement of the piston rod 310 will move the rollers 300 to determine the path of the transfer clamp 212 through the sewing machine.

Various means may be employed to control the operation of the sewing machine. One such system would be to provide a switch 314 on the frame 24 which is engageable by a trip lever 316 mounted on belt 164 (see FIG. 8). As the transfer clamp 212 is being fed through the machine the tripping of the switch 314 would start the sewing machine 20. Mounted on a bracket 318 is a photosensor 320 which cooperates with a piece of reflective tape 322 in a known manner to stop the machine upon completion of the desired length of stitching. After the transfer clamp 212 has been shifted the return movement of the transfer clamp 212 through the sewing machine causes the photosensor 320 to read the piece of reflector tape 324 to start the machine 20 to sew a second row of stitches. As the trip lever 316 passes the switch 314 it activates the switch 314 to stop the sewing machine 20. Various circuits can be employed to accomplish the starting and stopping through the controls described.

Mounted on the top 18 is a bracket 326 which supports an adjustable stop 328. This stop 328 assures the correct positioning of the transfer clamp 312 when it moves to the folding station.

Figure 12:
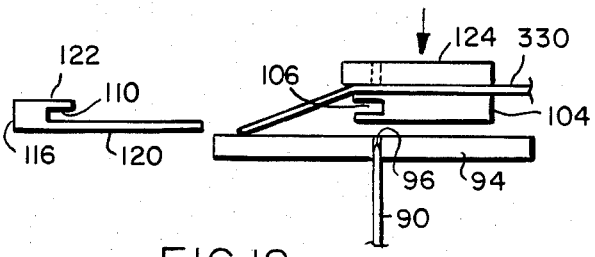
FIGS. 12 to 17 show the steps involved from the first placing of the garment panel in the machine to the completion of the folding.

The sequence of operations as seen in FIGS. 12 through 22 will now be described. The garment panel having the fly flap integral therewith is indicated at 330. The folds are to be made along the juncture line of the fly flap and the main panel. In the start position the transfer clamp 212 is not located at the folding station, the support plate 94 and pins 90 are disposed beneath the top 18, the upper clamping member 124 is raised and folding plates 104 and 116 are in their extreme left hand position as seen in FIG. 12. The work piece 330 is placed in position on folding plate 104 with the flap portion extending toward the folding plate 116. The upper clamping member 124 is then moved down to clamp the work piece 330 against the upper surface of folding plate 104 resulting in the positions shown in FIG. 12.

Figure 14:
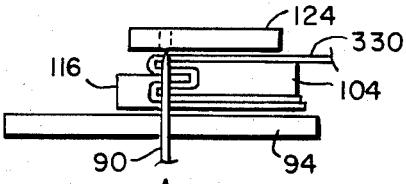

Folding plate 116 is then moved to the right which folds the work piece around folding plate 104. As the folding plate 116 moves to the right lip 120 first engages the fly flap folding it under plate 104. Further movement causes lip 122 to engage the work piece 330 and force it into the groove 106 in folding plate 104 thereby forming a first fold in the work piece 330. At the same time the lower lip of folding plate 104 will force the work piece 330 into groove 118 in folding plate 116 thereby forming a second fold in the work piece 330. When folding plate 116 has reached its extreme right hand position shown in FIG. 13, the pins 90 are raised to impale all of the folds as seen in FIG. 14.

Figure 15:
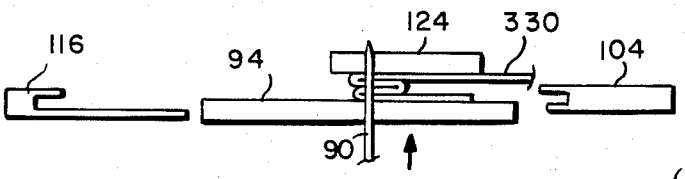

Upon completion of the upward motion of pins 90 folding plate 116 is withdrawn to the left and folding plate 104 is withdrawn to the right leaving the work piece 330 impaled on the pins 90. The upper clamping member 124 remains in position against the upper surface of the workpiece 330 and the support plate 94 is now raised to bear against the lower fold of the work piece 330. The top surface of support plate 94 is now flush with the top surface of the top 18 as seen in FIG. 15.

Figure 17:
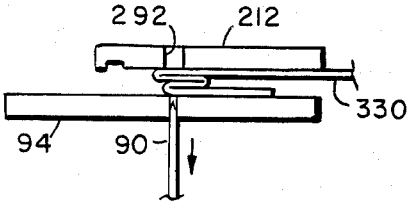
Figure 13:
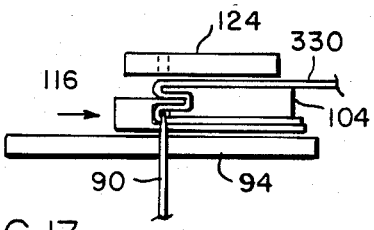
Figure 16:
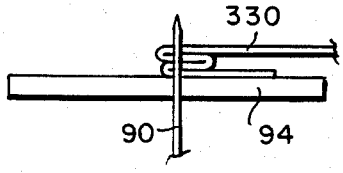
Figure 22:
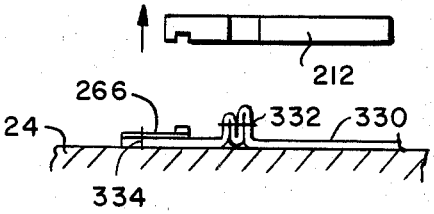
FIG. 22 shows the release of the parts after the sewing operation has been completed.

At this point the upper clamping member 124 is raised leaving the folded work piece 330 impaled on pins 90 and resting on support plate 94 as seen in FIG. 16. Cylinder 194 has been actuated rocking hanger 188 about its pivot thus causing arms 206 and 208 to raise transfer clamp 212 above top 18. Lever 248 is now actuated causing the rack 230 to drive gears 226 and 228 thereby swinging arms 206 and 208 to move the transfer clamp 212 into position above work piece 330. The cylinder 194 is now actuated in the opposite direction causing pivotting of hanger 188 thus lowering transfer clamp 212 against the work piece 330 and clamping the workpiece 330 against support plate 94 as seen in FIG. 17. The pins 90 are now withdrawn leaving the work piece 330 clamped by the transfer clamp 212 and the support plate 94.

Figure 18:
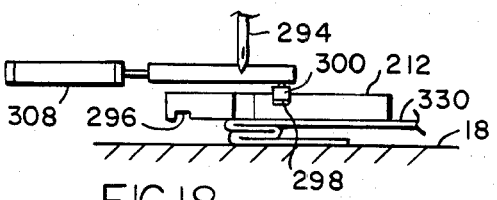
FIG. 18 shows the location of the various elements during the first sewing operation.

The rack 230 is now moved in the opposite direction swinging the arms 206 and 208 to move the transfer clamp 212 to the sewing machine 20. During the movement of the transfer clamp 212 it will continue to press down on the work piece 330 thereby moving it in folded condition to the sewing station. At this point belt 164 will move the hanger 188 thus drawing the transfer clamp 212 through the sewing machine as seen in FIG. 18. The rollers 300 will be in groove 298 thus assuring a straight row of stitches. The starting and stopping of the sewing machine will be controlled as previously described.

Figure 19:
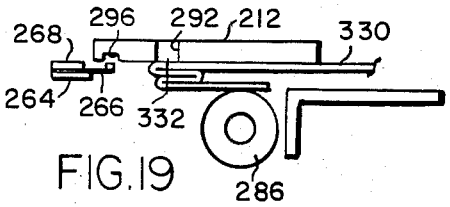
FIGS. 19 and 20 show the steps involved at the unfolding station.

Upon completion of the row of stitches 332 through the folds in the work piece 330 the transfer clamp 212 moves the work piece 330 to the unfolding and zipper placing station as seen in FIG. 19. At this point the folds are in their original position and the zipper clamp has been loaded with a predetermined length of zipper tape 266. The groove 296 in the bottom of transfer clamp 212 will now lie over the fastener elements of the zipper tape 266.

Figure 20:
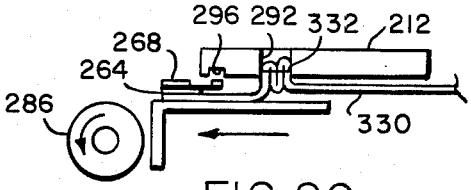

Lever 278 is now actuated causing roller 286 to move to the left as seen in FIG. 20. The movement and rotation of roller 286 causes the free edge of work piece 330 to be displaced from under the main body panel and causes the double fold to swing up into slot 292. The free edge of the work piece now extends beyond transfer clamp 212 and under the zipper clamp. The removal of the extra layers of work piece 330 allows transfer clamp 212 to descend further thereby trapping the fastener elements of zipper tape 266 within the groove 296. At that point cylinder 208 is actuated moving transfer clamp 212 slightly to the right as seen in FIG. 21.

Figure 21:
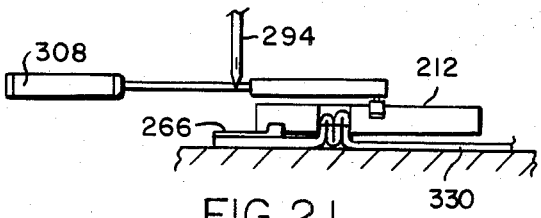
FIG. 21 shows the location of the elements during the second sewing operation.

This movement results in drawing the zipper tape 266 from the clamp and aligning the zipper tape with the needle 294 of the sewing machine as seen in FIG. 21. The transfer clamp 212 is now moved back through the sewing machine to provide a row of stitches 334 securing the zipper tape 266 to the free edge of the work piece 330. As seen in FIG. 21, the transfer clamp 212 is moved far enough to allow the needle 294 to pass closely adjacent the edge of the transfer clamp 212.

Upon completion of the row of stitches 334 the transfer clamp 212 is moved far enough for the rollers 300 to clear the groove 298 at which time the hanger 188 is rocked on its pivot by the cylinder 194 raising the clamp 212 to permit removal of the work piece 330.

It is understood that the invention is not limited to the embodiments shown and described, but many changes and modifications can be made without departing from the invention as defined in the appended claims.

What is claimed is:

1. A machine for forming a fly structure in a garment panel having the fly flap portion integral therewith comprising, a first station having folding means thereat for forming a fold in said fly flap portion along a line which is to become the exposed finished free edge in the completed fly structure, a second station having a sewing machine located thereat, a third station having slide fastener stringer feeding and positioning means thereat, and transfer means for sequentially transferring the folded garment panel from said first station to said second station and through said sewing machine for stitching said fold, then from said second station to said third station for placement of a slide fastener stringer thereon, then transferring the garment panel back to said second station and again through said sewing machine to form a second line of stitching to secure said slide fastener stringer to said garment panel.

2. In a machine according to claim 1 wherein, said third station includes unfolding means for unfolding the fly flap portion to enable the placement of the slide fastener stringer thereon.

3. In a machine according to claim 1 wherein said folding means comprises, a first member mounted on said machine for horizontal movement on which the garment panel is placed with the fly flap portion extending beyond the edge of the first member, a second member mounted on said machine for horizontal movement toward and away from said first member for engagement with fly flap portion, and said second member having a portion thereof capable of passing under said first member when said second member is moved toward said first member to thereby fold the fly flap.

4. In a machine according to claim 3 wherein, said first member is provided with upper and lower lips extending toward said second member and defining a recess opening toward said second member.

5. In a machine according to claim 4 wherein, said second member is provided with upper and lower lips extending toward said first member and defining a recess opening toward said first member, said lower lip on said second member extending a greater distance toward said first member than said upper lip on said second member, and said second member being vertically offset lower than said first member whereby as the first and second members move relative to each other the upper lip of said second member will enter the recess in the first member, the lower lip of the second member will pass under the lower lip of the first member and the lower lip of the first member will enter the recess in the second member.

6. In a machine according to claim 4 wherein, said upper lip on said first member extends a greater distance toward said second member than said lower lip.

7. In a machine according to claim 5 wherein, said folding means includes and upper clamp plate mounted for vertical movement on said machine above said first member and cooperating with said first member to clamp the garment panel in position on said first member.

8. In a machine according to claim 7 wherein, said folding means includes a bottom clamp plate mounted for vertical movement below said first member and cooperating with said upper clamp plate to support and compress the folds formed in the garment panel after the first and second member have been withdrawn from contact therewith.

9. In a machine according to claim 8 wherein, said folding means includes a bar located on said machine below said bottom clamp plate for vertical movement toward and away from said bottom clamp plate, said upper and bottom clamp plates and said first and second members each being provided with a plurality of apertures aligned with the apertures in the other elements, and a series of pins mounted on said bar in alignment with said apertures whereby the pins will pass through the elements as the bar is moved upwardly toward the bottom clamp member.

10. In a machine according to claim 9 wherein said transfer means comprises, a transfer clamp plate mounted for both vertical and horizontal movement on said machine, said transfer clamp plate being provided with an elongated slot adjacent one edge thereof and adapted to register with said series of pins as said transfer clamp plate moves downwardly over said folded garment panel after said upper clamp plate has been moved vertically upward away from the folds in the garment panel.

11. In a machine according to claim 10 wherein, said sewing machine is provided with indexing means for controlling said transfer clamp plate as it passes through said sewing machine whereby said transfer clamp plate will be fed through said sewing machine in a first direction along a predetermined first line and will be fed along a line offset from said first line when fed in the opposite direction.

12. In a method according to claim 11 wherein, the needle of the sewing machine forms a line of stitches within the elongated slot in the transfer clamp plate during the first movement of the transfer clamp plate through said sewing machine, and the needle forms a second line of stitches adjacent the outside edge of the transfer clamp plate during the feeding of the transfer clamp plate in the opposite direction.

13. In a machine according to claim 12 wherein, said unfolding means includes a plate mounted for movement transverse to the direction of travel of said transfer clamp plate through said sewing machine, said plate having a roller mounted thereon and in engagement with the folded fly flap portion when said garment panel has been moved to said third station, and said roller being rotated as it moves with said plate to cause said folded fly flap portion to move from beneath the garment panel.

14. In a machine according to claim 12 wherein, said transfer clamp plate is provided with a groove in the bottom surface thereof between the elongated slot and the said one edge thereof, said groove adapted to receive the slide fastener elements of the said slide fastener stringer as said transfer clamp plate moves into said third station, and said indexing means shifting said transfer clamp after said roller has unfolded the flap portion to align the longitudinal axis of the slide fastener stringer with the needle of the sewing machine.

15. In a machine according to claim 14 wherein said transfer clamp moves the garment panel from the third station to said second station with the slide fastener stringer in position on the unfolded flap portion, and said sewing machine stitches said slide fastener stringer to said tape as said transfer clamp moves the garment panel through said second station in reverse direction.

16. In a machine according to claim 15 wherein, said second station is provided with detecting means indicating the arrival of the folded garment panel from said first station to start the sewing machine, and limiting means are provided to stop the sewing machine after a predetermined length of stitching has been accomplished.

17. In a machine according to claim 16 wherein, said limiting means indicates the arrival of the unfolded flap and slide fastener stringer from said third station to start the sewing machine, and said detecting means stops said sewing machine after a predetermined length of stitching has been accomplished.

18. In a machine according to claim 17 wherein, said limiting means actuating said slide fastener feeding means at the time of actuating said sewing machine on arrival of the garment panel from the third station, and said detecting means stopping said slide fastener feeding means at the time when said sewing machine is stopped.

19. A machine for forming a fly structure in a garment panel having the fly flap portion integral herewith comprising, a first station having folding means thereat for forming a fold in said fly flap portion along a line which is to become the exposed finished free edge in the completed fly structure, a second station having a sewing machine located thereat, a third station having slide fastener stringer feeding and positioning means thereat, transfer means for sequentially transferring the folded garment panel from said first station to said second station and through said sewing machine for stitching said fold, then from said second station to said third station for placement of a slide fastener stringer thereon, then transferring the garment panel back to said second station and again through said sewing machine to form a second line of stitching to secure said slide fastener stringer to said garment panel, said transfer means feeding said folded garment panel along a first predetermined line through said sewing machine during the first movement through said sewing machine, and said transfer means feeding the garment panel along a second predetermined line offset from said first predetermined line during the second movement through said sewing machine.

20. In a machine according to claim 19 wherein, guide means are mounted on said sewing machine, said guide means engaging said transfer means when said transfer means is at said second station to direct the transfer means along predetermined paths through said sewing machine.

21. In a machine according to claim 20 wherein, said guide means being in engagement with said transfer means when said transfer means is at said third station, and said guide means being actuated to index said transfer means at said third station, said guide means being actuated after said unfolding means has completed its movement.

22. A machine for forming a fly structure in a garment panel having the fly flap portion integral therewith comprising, folding means for folding said fly flap portion under said garment panel along a predetermined line, said folding means having first and second members movable laterally toward each other to fold said fly flap portion under said garment panel, each of said members having an upper lip and a lower lip extending in the direction of the other member and defining a longitudinal opening facing the opposite member, and the upper and lower lips of one member being vertically offset from the upper and lower lips of the other member whereby the upper lip of one member will enter the opening in the other member while the lower lip of the said other member will enter the opening in said one member.

23. In a machine according to claim 22 wherein, said upper and lower lips of each of said members are provided with aligned slots extending inwardly from the free edges thereof to the bottom of the respective openings in said members, a bar mounted on said machine for vertical movement beneath said members, and said bar having a plurality of pins mounted thereon and extending upwardly therefrom in alignment with the slots in said members whereby upon upward movement of said bar said pins will pass upward through the aligned slots in said members and impale the folds formed in the fly flap portion of the garment.

24. In a machine according to claim 23 wherein, said folding means includes a bottom clamp member mounted for vertical movement beneath said first and second members, a top clamp member mounted for vertical movement above said first and second members, and said bottom at top clamp members being provided with aligned apertures permitting the passage of said pins upwardly therethrough.

25. In a machine according to claim 24 wherein, said pins are of a length sufficient to pass through the folds in the fly flap portion and retain the folds thereon while said first and second members are moved away from each other and the top clamp member is moved vertically upward away from the bottom clamp member.

26. In a machine according to claim 25 wherein, transfer means are provided for moving the folded garment panel from the folding means, said transfer means comprising in alignment with said pins, said plate clamping said garment panel permitting removal of said pins therefrom, and said plate sliding said garment panel from the folding means after withdrawal of said pins.

* * * * *